US010672373B2

(12) United States Patent
Nakamura

(10) Patent No.: US 10,672,373 B2
(45) Date of Patent: Jun. 2, 2020

(54) KEYBOARD MUSICAL INSTRUMENT, METHOD, AND NON-TRANSITORY COMPUTER-READABLE RECORDING MEDIUM

(71) Applicant: CASIO COMPUTER CO., LTD., Shibuya-ku, Tokyo (JP)

(72) Inventor: Atsushi Nakamura, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 136 days.

(21) Appl. No.: 15/926,119

(22) Filed: Mar. 20, 2018

(65) Prior Publication Data

US 2018/0277080 A1 Sep. 27, 2018

(30) Foreign Application Priority Data

Mar. 22, 2017 (JP) ..... 2017-056475

(51) Int. Cl.
*G10C 3/12* (2006.01)
*G10H 1/34* (2006.01)
*G10H 1/00* (2006.01)

(52) U.S. Cl.
CPC ..... *G10H 1/34* (2013.01); *G10H 1/0008* (2013.01); *G10H 1/344* (2013.01); *G10H 2220/011* (2013.01); *G10H 2220/231* (2013.01)

(58) Field of Classification Search
CPC ..... G10H 1/34; G10H 2220/231
USPC ..... 84/439
See application file for complete search history.

(56) References Cited

U.S. PATENT DOCUMENTS

2012/0081239 A1* 4/2012 Robinson ..... G06F 3/0238 341/22
2016/0034446 A1* 2/2016 Yamamoto ..... G10H 7/008 704/9

FOREIGN PATENT DOCUMENTS

| | | | |
|---|---|---|---|
| JP | 06324677 | A | 11/1994 |
| JP | 2004118425 | A | 4/2004 |
| JP | 2006163727 | A | 6/2006 |
| JP | 2016157142 | A | 9/2016 |

* cited by examiner

*Primary Examiner* — Jainchun Qin
(74) *Attorney, Agent, or Firm* — Holtz, Holtz & Volek PC

(57) ABSTRACT

A keyboard musical instrument, a method, and a non-transitory computer-readable recording medium that improve operability are provided. An electronic musical instrument comprises a keyboard including plural white keys each of which is allocated with plural characters and plural black keys, and a controller. The controller executes, in a musical sound producing mode that is set, accepting a sound producing instruction of a musical sound in response to an operation of the keyboard, and, in a symbol input mode that is set, according to both a white key designated from the plural white keys and a black key designated from the plural black keys, accepting an input of a character among the plural characters allocated to the white key designated from the plural white keys.

11 Claims, 8 Drawing Sheets

FIG.3

DM

| IDENTIFIER | WHITE KEY 102'A | WHITE KEY 102'B | WHITE KEY 102'C | WHITE KEY 102'D | WHITE KEY 102'E | WHITE KEY 102'F | WHITE KEY 102'G |
|---|---|---|---|---|---|---|---|
| 1 | a | b | c | d | e | f | g |
| 2 | h | i | j | k | l | m | n |
| 3 | o | p | q | r | s | t | u |
| 4 | v | w | x | y | z | , | . |

KEYBOARD MUSICAL INSTRUMENT, METHOD, AND NON-TRANSITORY COMPUTER-READABLE RECORDING MEDIUM

CROSS-REFERENCE TO RELATED APPLICATION

This application claims the benefit of Japanese Patent Application No. 2017-056475, filed on Mar. 22, 2017, the entire disclosure of which is incorporated by reference herein.

FIELD

The present disclosure relates to a keyboard musical instrument, a method, and non-transitory computer-readable recoding medium.

BACKGROUND

An electronic musical instrument that produces musical sound according to a key pressing operation on a key by a user is known. For example, Patent Literature 1 discloses an electronic keyboard musical instrument that emits a musical sound signal according to an operation of a keyboard.

[Patent Literature 1] Unexamined Japanese Patent Application Kokai Publication No. 2016-157142

In some cases, a user desires to input character information such as lyrics or a song title and the like into the electronic keyboard musical instrument described in Patent Literature 1. In such a case, the electronic keyboard musical instrument described in Patent Literature 1 cannot accept an input of character information, and was insufficient from the viewpoint of improving the operability for the user. Thus, improvement of operability is desired.

The present disclosure is made in consideration of the above-described situation, and one of its advantage is to provide a keyboard musical instrument, a method, and a non-transitory computer-readable recording medium that improves operability.

SUMMARY

To achieve the above-described objective, an embodiment of the present disclosure is a keyboard musical instrument comprising:

a keyboard including plural white keys and plural black keys, wherein each of the plural white key is allocated with plural characters; and a processor that executes:

in a musical sound producing mode that is set, accepting a sound producing instruction of a musical sound in response to an operation of the keyboard; and in a symbol input mode that is set, according to both a white key designated from the plural white keys and a black key designated from the plural black keys, accepting an input of a character among the plural characters allocated to the white key designated from the plural white keys.

BRIEF DESCRIPTION OF THE DRAWINGS

A more complete understanding of this application can be obtained when the following detailed description is considered in conjunction with the following drawings, in which:

FIG. 3 is a diagram showing an example of configuration of character correspondence data;

DETAILED DESCRIPTION

Figure 1:
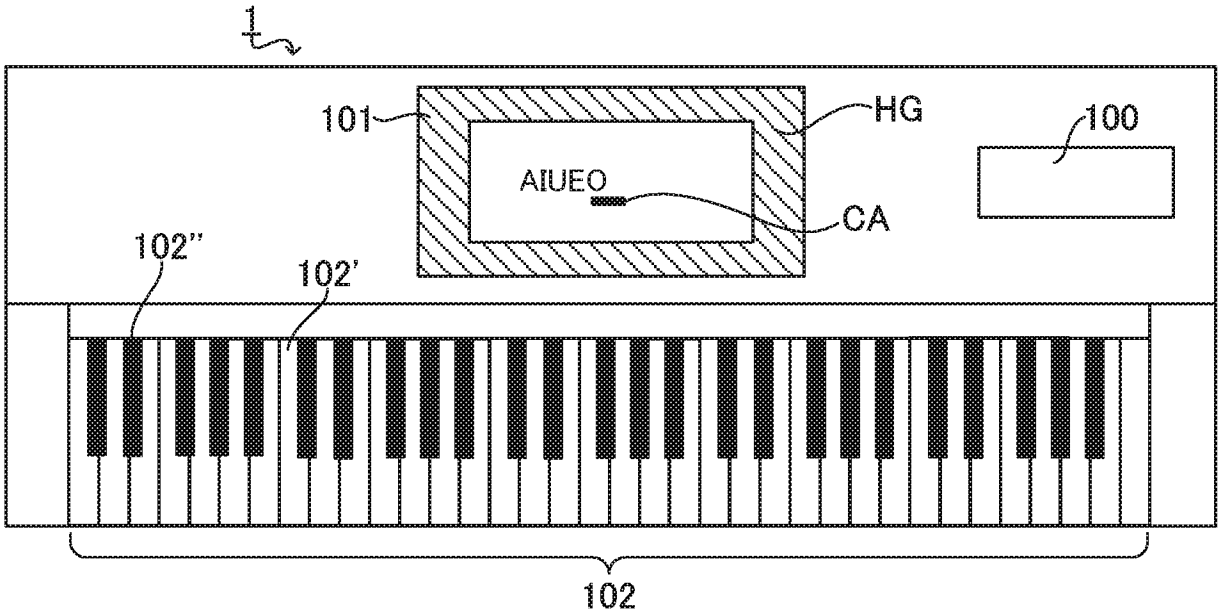
FIG. 1 is a diagram showing an external appearance of the electronic musical instrument according to the embodiment of the present disclosure.

Hereinafter, the electronic musical instrument according to the embodiment of the present disclosure is described with reference to the drawings. In the drawings, same or similar configurations are denoted by same reference signs.

The electronic musical instrument 1 shown in FIG. 1 comprises a keyboard 102 including a plurality of white keys 102' and a plurality of black keys 102", and operates according to one of a plurality of operation modes, which is set in advance. Specifically, as operation modes of the electronic musical instrument 1, musical sound producing mode, symbol input mode, and singing sound producing mode are set. The electronic musical instrument 1 accepts, by operating according to the musical sound producing mode, a sound producing instruction of a musical sound according to a key pressing operation by a user on a key included in the keyboard 102, and produces a musical sound according to this sound producing instruction. The electronic musical instrument 1 accepts, by operating according to the symbol input mode, a symbol input of information including a character, according to a key pressing operation by a user on a key included in the keyboard 102. Hereinafter, a case that the electronic musical instrument 1 generates lyrics by accepting symbol input including characters in the symbol input mode will be described as an example. The electronic musical instrument 1 utters, by operating according to the singing sound producing mode, lyrics generated by the symbol input accepted in the symbol input mode at a designated pitch. Hereinafter, a case that the electronic musical instrument 1 utters, in the singing sound producing mode, lyrics generated in the symbol input mode at a pitch designated by a sound producing instruction, which is accepted in the musical sound producing mode, will be described as an example.

The electronic musical instrument 1 comprises an operator 100, an image displayer 101, and the above-described keyboard 102.

The operator 100 comprises an operational means such as a button and the like, and accepts an instruction operation by a user. The operator 100 provides data representing the accepted instruction operation to a controller 103 that is described later. Specifically, the operator 100 comprises a volume control button, a mode selection button, a start button, and an end button, each of which is not illustrated. The volume control button is a button for setting the volume of a musical sound and a lyrics sound produced by the electronic musical instrument 1. The mode selection button is a button for selecting one of the above-described musical sound producing mode, symbol input mode, and singing sound producing mode as the operation mode of the electronic musical instrument 1. The start button is a button for instructing the electronic musical instrument 1 to start an operation according to an operation mode selected by mean of an operation to the mode selection button. The end button is a button for instructing the electronic musical instrument 1 to end an operation according to an operation mode selected by mean of an operation to the mode selection button.

The image displayer 101 comprises a display apparatus such as a liquid crystal panel and the like, and displays various images according to the control by a controller 103 described later. Specifically, the image displayer 101 displays, in the symbol input mode, an editing screen HG shown in FIG. 1. The editing screen HG is an image that shows a status of progress of the symbol input. Specifically, the editing screen HG includes a cursor CA that is an icon indicating current position of the symbol input, and an image representing information accepted in the symbol input by the electronic musical instrument 1. The displayed content of the editing screen HG is renewed sequentially according to the progress of the symbol input accepting process described later. The user performs, when the electronic musical instrument 1 is operating in the symbol input mode, a symbol input by performing a key pressing operation on a key included in the keyboard 102, while watching the editing screen HG displayed on the image displayer 101.

The keys included in the keyboard 102 are respectively associated with musical sounds having pitches different from each other in advance. Specifically, a plurality of white keys 102' included in the keyboard is respectively associated with different natural tones. Also, a plurality of black keys 102" included in the keyboard is respectively associated with different derived tones. In the musical sound producing mode, when a user performs a key pressing operation, the electronic musical instrument 1, in response, accepts the sound producing instruction of the musical sound whose pitch is associated with the key on which the key pressing operation is performed, and produces the musical sound having the pitch. More specifically, the keys included in the keyboard 102 are respectively assigned with note numbers representing pitches of musical sounds associated with each of the keys. While the details will be described later, when the user performs a key pressing operation, the detector 107 that is described later detects the key pressing operation, and provides a note-on message that includes the note number assigned to the key on which the key pressing operation is performed to the controller 103 that is described later. In the musical sound producing mode, the controller 103 controls the musical sound source 108 and the sound outputter 110 that are described later, and causes them to produce a musical sound according to the note number.

Also, some of the keys included in the keyboard 102 are respectively further associated with information different from each other is further associated respectively. While the details will be described later, in the symbol input mode, when the user performs a key pressing operation, the electronic musical instrument 1, in response, accepts the symbol input according to the information associated with the key on which the key pressing operation is performed. More specifically, when the user performs a key pressing operation, the detector 107 that is described later detects the key pressing operation, and provides a note-on message that includes the note number assigned to the key on which the key pressing operation is performed to the controller 103 that is described later. The controller 103 specifies, in the symbol input mode, the key on which the key pressing operation is performed based on the note number, and accepts the symbol input according to the information associated with the key. That is, in the symbol input mode, the note number functions as an identifier assigned to the key. The details of accepting of the symbol input by the electronic musical instrument 1 will be described later. Hereinafter, a correspondence relation between a key included in the keyboard 102 and information is described with reference to FIG. 2 and FIG. 3.

Figure 2:
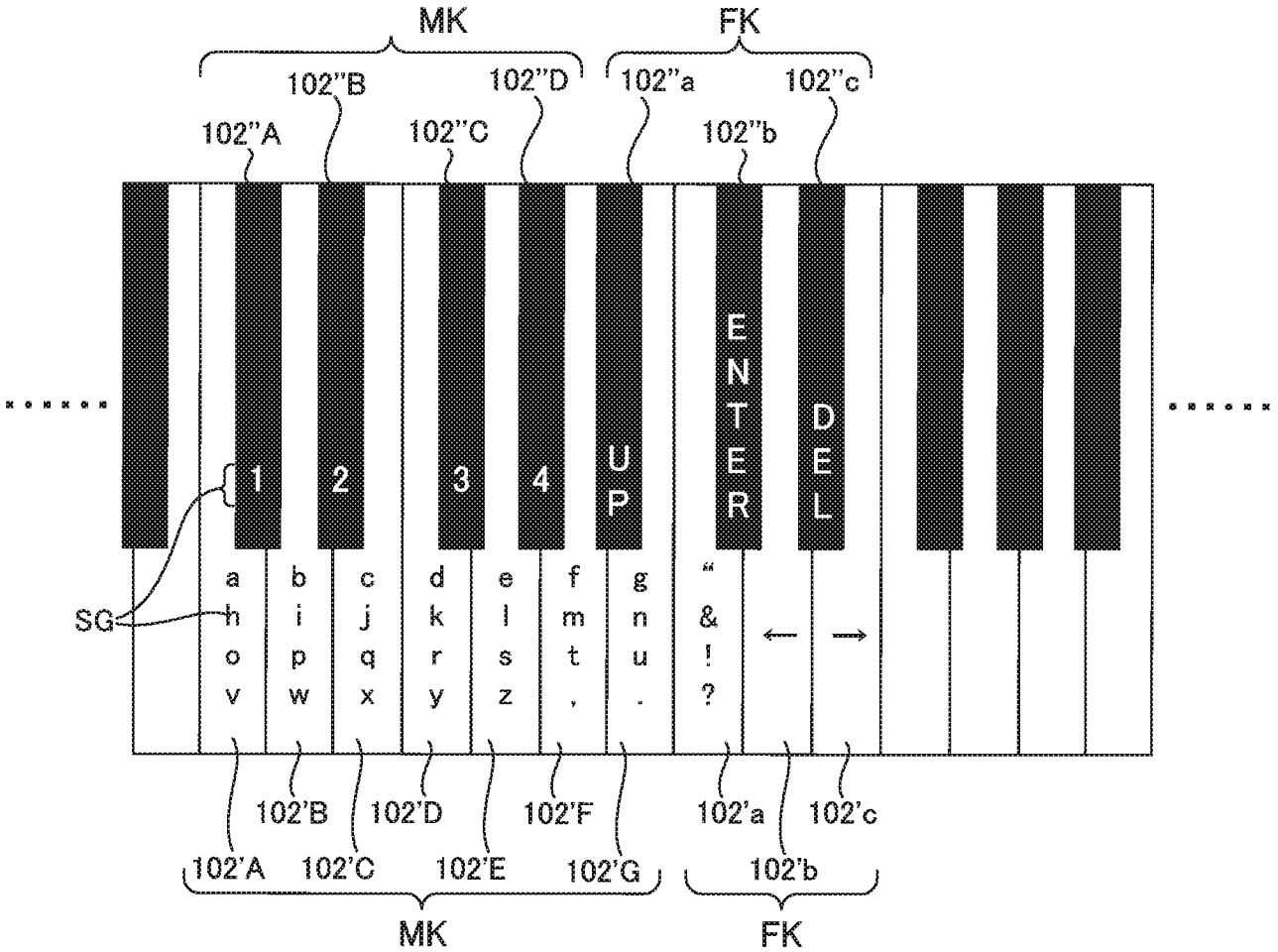
FIG. 2 is a first diagram for describing a correspondence relation between a key and information.

As shown in FIG. 2, some keys of the keys included in the keyboard 102 are set as character input keys MK in advance. The electronic musical instrument 1 accepts, in response to a key pressing operation on a character input key MK by a user, a symbol input of a character. The character input keys MK are adjacent to one another, and includes white keys 102'A to 102'G and black keys 102"A to 102"D, corresponding to the sound range of one octave out of the plurality of octaves playable by use of the keyboard 102. That is, keys included in the character input keys MK are included within one octave. The black keys 102"A to 102"D are respectively associated with identifiers "1" to "4". The white keys 102'A to 102'G are respectively associated with a plurality of pieces of information including a character. For example, the white key 102'F is associated with characters "f", "m", "t" and comma ",", and the white key 102'G is associated with characters "g", "n", "u" and period ".". The plurality of pieces of information associated with the white keys 102'A to 102'G is respectively associated with one of the identifiers "1" to "4". The character correspondence data DM shown in FIG. 3 is stored in the read only memory (ROM) 105 described later, and represents the correspondence relation between the plurality of pieces of information associated with white keys 102'A to 102'G included in the character input keys MK and the identifiers "1" to "4". While the details are described later, the electronic musical instrument 1 accepts a symbol input of a character by referring to the character correspondence data DM. That is, as shown in FIG. 2, a plurality of characters is assigned to each of the plurality of white keys. At least one vowel character and a plurality of consonant characters are assigned to at last one of the plurality of white keys. Also, the plurality of characters assigned to each of the plurality of white keys is displayed while being arranged in one vertical column. In the symbol input mode that is set, the controller 103 performs the symbol input accepting process that accepts an input of one of the plurality of characters assigned to one of the plurality of white keys that is designated according to an operation by the user, according to one of the plurality of the white keys designated according to an operation by the user and one of the plurality of black keys designated according to an operation by the user. According to one of the plurality of black keys designated according to an operation by a user, one row of the plurality of characters arranged in a vertical column on each of the plurality of white keys is designated. The number of the plurality of black keys is the same as the number of the plurality of characters assigned to each white key. With respect to the order of designating the white key and the black key, a character may be specified by designating a black key after designating a white key, or a character may be specified by designating a white key after designating a black key, or a character may be specified by designating a white key and a black key almost at the same time. One advantage of arranging these plurality of white keys and plurality of black keys within a range (a range within 1 to 2 octaves) that the user can operate with one hand (one of right hand and left hand) is that the input of characters becomes easy. This is realized by assigning a plurality of characters on a white key.

Referring to FIG. 2 again, the white keys 102'*a* to 102'*c* and the black keys 102"*a* to 102"*c* adjacent to the character input keys MK are set as information input keys FK in advance. Each of the keys included in the information input keys FK are respectively associated with information that is different from characters such as a symbol, an editing command for instructing an editing process on information inputted by symbol input, or an instruction command for instructing an operation of the electronic musical instrument 1 and the like. In response to a key pressing operation on an information input key FK by the user, the electronic musical instrument 1 accepts a symbol input of information other than a character. Specifically, the white key 102'*a* is associated with a plurality of special characters "'", "&", "!" and "?". The plurality of special characters associated with the white key 102'*a* is respectively associated with one of the identifiers "1" to "4" is associated respectively with. The white key 102'*b* is associated with an operation command for instructing to move forward the current symbol input position. Note that, the cursor CA included in the editing screen HG shown in the above-described FIG. 1 moves forward in response to the pressing of the white key 102'*b*. The white key 102'*c* is associated with an operation command for instructing to move backward the current symbol input position. The cursor CA included in the editing screen HG shown in the above-described FIG. 1 moves backward in response to the pressing of the white key 102'*c*. The black key 102"*a* is associated with an editing command for instructing to perform a symbol input for inputting a character at the current symbol input position as a capital letter. The electronic musical instrument 1 accepts a symbol input of a capital letter corresponding to the character at the current symbol input position in response to the pressing of the black key 102"*a*. The black key 102"*b* is associated with an editing command for instructing to determine the current content of the symbol input. While the details are described later, the electronic musical instrument 1 acquires the current content of the symbol input as lyrics, in response to the pressing of the black key 102"*b*, in the symbol input mode. The black key 102"*c* is associated with an editing command for instructing to delete the information input by the symbol input at the current symbol input position. As described later, the ROM 105 stores information correspondence data DF that represents a correspondence relation between a key included in the information input keys FK and the information associated with each key. While the details will be described later, the electronic musical instrument 1 accepts a symbol input of information other than a character by referring to the information correspondence data DF.

Any key included in the keyboard 102 transmits light. While the details will be described later, the keyboard displayer 106, which will be described later, displays, on the character input keys MK and information input keys FK, a symbol image SG representing the information associated with each key, by selectively transmitting light through a key. The user performs a symbol input by performing a key pressing operation while watching the symbol image SG.

Figure 4:
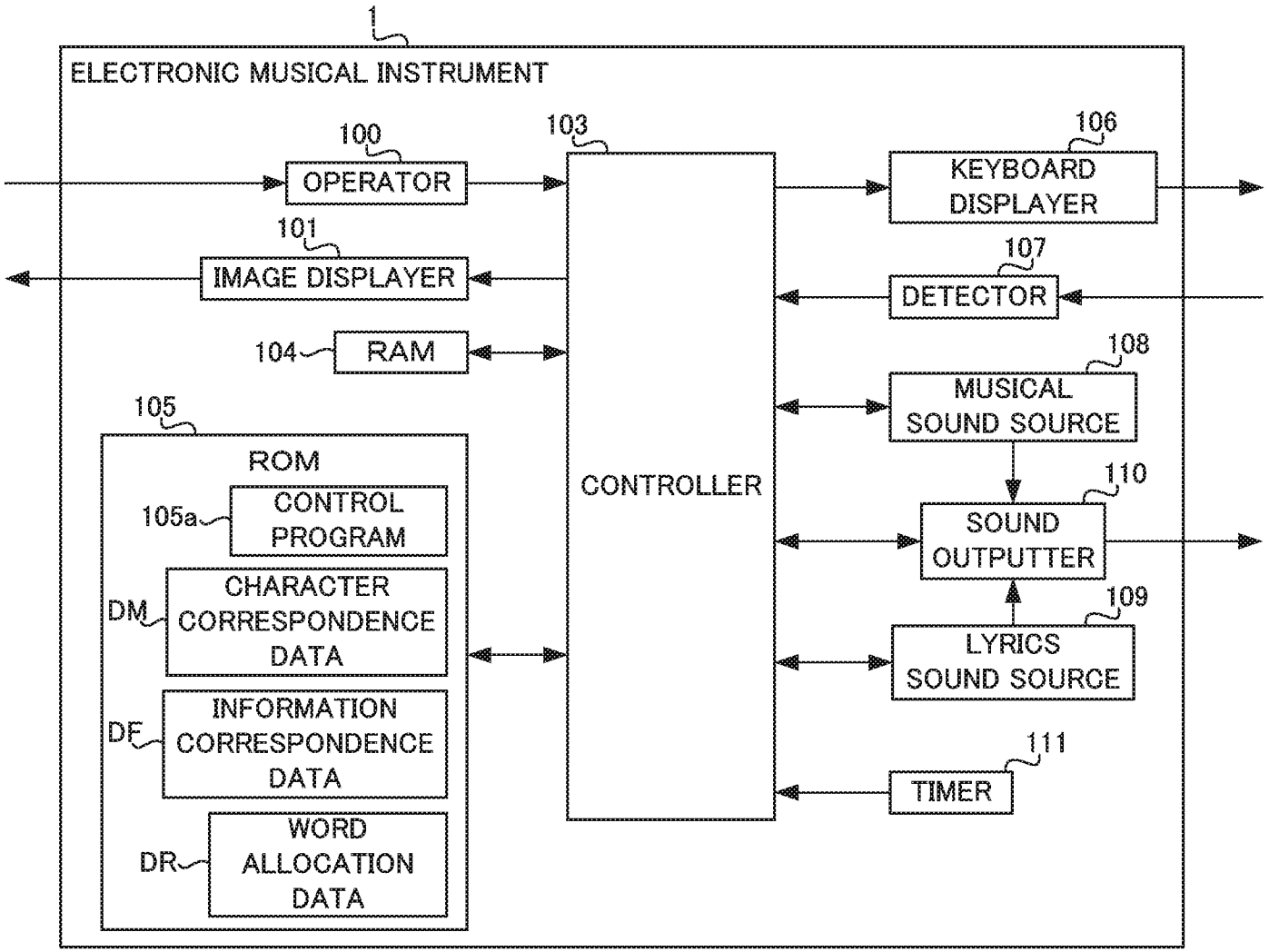
FIG. 4 is a diagram showing an electrical configuration of the electronic musical instrument according to the embodiment of the present disclosure.

As shown in FIG. 4, the electronic musical instrument 1 comprises, in addition to the above-described components, a controller 103, a random access memory (RAM) 104, a ROM 105, a keyboard displayer 106, a detector 107, a musical sound source 108, a lyrics sound source 109, a sound outputter 110, and a timer 111.

The controller 103 comprises a central processing unit (CPU), and performs various processes including sound producing instruction accepting process, symbol input accepting process, and singing sound producing process, which will be described later, according to a program and data stored in the ROM 105. The controller 103 is connected to each part of the electronic musical instrument 1 via a system bus that is a transmission path of a command and data, and performs integrated control of the whole electronic musical instrument 1.

The RAM 104 stores data generated or acquired by the controller 103 by performing various processes. Specifically, the RAM 104 stores musical sound data generated by the controller 103 in the sound producing instruction accepting process that will be described later, and lyrics data generated by the controller 103 in the symbol input accepting process that will be described later. Also, the RAM 104 functions as a work area of the controller 103. That is, the controller 103 reads out a program and data to the RAM 104, and performs various processes by appropriately referring to the program and data that are read out.

The ROM 105 stores a program and data used by the controller 103 to perform various processes. Specifically, the ROM 105 stores a control program 105*a* executed by the controller 103. Also, the ROM 105 stores character correspondence data DM, information correspondence data DF, and word allocation rule data DR. The character correspondence data DM is data representing correspondence relation between a plurality of pieces of information including a character that is associated with white keys 102'A to 102'G included in the above-described character input keys MK and the identifiers "1" to "4". The information correspondence data DF is data representing correspondence relation between a key included in the information input keys FK and information. Specifically, the information correspondence data DF includes a note number assigned to a key included in the information input keys FK and information associated with the key, in association with each other. Also, the information correspondence data DF includes information that indicates correspondence relation between the identifiers "1" to "4" and a plurality of special characters associated with a white key 102'*a* included in the information input keys FK. The character correspondence data DM and the information correspondence data DF are generated in an external apparatus such as a computer and the like, by accepting a setting operation by the user. The electronic musical instrument 1 acquires the character correspondence data DM and the information correspondence data DF via an external interface that is not illustrated from the external apparatus, and stores them in the ROM 105 in advance. The details of the word allocation rule data DR will be described later.

The keyboard displayer 106 displays, on the character input keys MK and information input keys FK, a symbol image SG shown in FIG. 2 representing the information associated with each key, according to the control by the controller 103. Specifically, the keyboard displayer 106 comprises a light source such as a light emitting diode (LED) and the like, and a first light shielding member and a second light shielding member that do not transmit light, each of which is not illustrated, and displays a symbol image SG by selectively transmitting light through a key. The light source is incorporated in a main body of the electronic musical instrument 1, and irradiates light at a back surface of the character input keys MK and information input keys FK. The turning on and turning off of the light source is controlled by the controller 103. The back surface is a surface opposite to a front surface that is a surface on which a finger of the user touches during the key pressing operation, among surfaces included in a key. The first light shielding member is arranged on the back surface of a white key 102' included in the character input keys MK and the information input keys FK, and has a shape of a symbol image representing the information associated with each white key 102'. As described above, any key included in the keyboard 102 transmits light. When light is irradiated by the light source on the back surface of the white key 102' included in the character input keys MK and information input keys FK, the light is shielded by the first light shielding member and not transmitted through key in an area of the white key 102' where the first light shielding member is arranged, while the light is transmitted through key in other area of the white key 102'. As a result, the symbol image is displayed with shadow on the front surface of the white key 102'. The second light shielding member is arranged to cover the whole back surface of a black key 102" included in the character input keys MK and the information input keys FK, and has a cut out part which has a shape of a symbol image representing the information associated with each black key 102'. When light is irradiated by the light source on the back surface of the black key 102" included in the character input keys MK and information input keys FK, the light is transmitted through key at the cut out part of the second light shielding, while the light is shielded by the second light shielding member in other area that is covered with the second light shielding member, and is not transmitted. As a result, the symbol image is displayed with light on the front surface of the black key 102".

The detector 107 comprises a sensor that is not illustrated, and detects an operation by a user on a key included in the keyboard 102, and provides a detection signal to the controller 103 representing a mode of the operation. Specifically, when a key pressing operation by the user is detected, the detector 107 provides a note-on message that includes a note number assigned to a key on which the key pressing operation is performed and velocity that represents the strength of the key pressing operation to the controller 103. Also, when a key releasing operation is detected, the detector 107 provides a note-off message that includes a note number assigned to a key on which the key releasing operation is performed to the controller 103.

The musical sound source 108 generates a digital musical sound signal representing a musical sound, and provides it to the sound outputter 110 according to the control by the controller 103. As described later, the sound outputter 110 produces a sound in accordance with an analog-digital signal according to a digital musical sound signal being provided. Specifically, in the musical sound producing mode, the musical sound source 108 generates a digital musical sound signal representing a musical sound associated with a key on which a key pressing operation is performed. Also, while the details will be described later, in the singing sound producing mode, the musical sound source 108 generates a digital musical sound signal that represents a musical sound included in singing sound producing data, which will be described later, being provided by the controller 103. More specifically, the musical sound source 108 comprises a non-volatile memory such as a hard disk drive (HDD) and the like, that is not illustrated, and stores sample musical sound data. The sample musical sound data includes a note number and sound waveform data of sample musical sound having a pitch represented by each note number in association with each other. The electronic musical instrument 1 acquires the sample musical sound data generated by an external apparatus such as a computer and the like from the external apparatus via the above-described external interface, and stores the acquired sample musical sound data in the above-described non-volatile memory of the musical sound source 108 in advance. In the musical sound producing mode, in response to the detector 107 detecting the key pressing operation by the user, the controller 103 provides a note-on message that includes a note number and velocity provided by the detector 107 to the musical sound source 108. The musical sound source 108 acquires the sound waveform data stored in the sample musical sound data in association with the note number included in the note-on message. The musical sound source 108 adjusts the volume of the sample musical sound represented by the acquired sound waveform data, according to the velocity included in the note-on message. As a result, the musical sound source 108 generates a digital musical sound signal representing a musical sound according to the key pressing operation. Also, while the details will be described later, in the singing sound producing mode, the controller 103 provides singing sound producing data in which a note-on message and a note-off message as note information for specifying a musical sound are stored to the musical sound source 108. The musical sound source 108, by performing a process that is similar to the above-described process in the musical sound producing mode using the note number and the velocity included in the note-on message, generates a digital musical sound signal representing a musical sound included in the singing sound producing data.

The lyrics sound source 109 generates a digital lyrics signal representing lyrics according to the control by the controller 103, and provides it to the sound outputter 110. As described later, the sound outputter 110 produces a sound in accordance with an analog lyrics signal according to the provided digital lyrics signal. Specifically, the lyrics sound source 109 comprises a non-volatile memory such as an HDD and the like that is not illustrated, and stores a plurality of pieces of sound element data representing sound waveform of a sound element. The electronic musical instrument 1 acquires the sound element data generated by an external apparatus such as a computer and the like from the external apparatus via the above-described external interface, and stores the acquired sound element data in the above-described non-volatile memory in advance. While the details will be described later, in the singing sound producing mode, the controller 103 provides the singing sound producing data, that will be described later, that includes lyrics, and a note-on message and a note-off message as note information representing a musical sound in association with each other to the lyrics sound source 109. The lyrics sound source 109 acquires sound element data of sound element according to the lyrics, and generates a digital lyrics signal by adjusting the pitch of the sound element data to the pitch represented by the note number included in the note-on message that is stored in association with the lyrics.

The sound outputter 110 outputs a sound according to control by the controller 103. Specifically, the sound outputter 110, in the musical sound producing mode and the singing sound producing mode, produces sound on the basis of the analog musical sound signal according to the digital musical sound signal provided by the musical sound source 108. Also, in the singing sound producing mode, the sound outputter 110 produces sound on the basis of the analog lyrics signal according to the digital lyrics signal provided by the lyrics sound source 109. More specifically, the sound outputter 110 comprises a Digital to Analog (D/A) conversion circuit, an amplifier, and a speaker, each of which is not illustrated. D/A conversion circuit converts the digital musical sound signal and the digital lyrics signal to analog musical sound signal and analog lyrics signal respectively, and provides them to the amplifier. The amplifier adjusts, by adjusting the amplitude of the analog musical sound signal and the analog lyrics signal that are provided, the volume of the analog musical sound signal and the analog lyrics signal to the volume set by an operation to the above-described volume control button of the operator 100. The speaker produces sound according to the analog musical sound signal and the analog lyrics signal whose volume has been adjusted by the amplifier. Note that, sound producing and sound stopping by the sound outputter 110 is performed in accordance with the control by the controller 103. Specifically, in the musical sound producing mode, the controller 103 causes the sound outputter 110 to start producing sound according to the analog musical sound signal in response to the providing of a note-on message by the detector 107, and then, causes the sound outputter 110 to stop producing sound in response to the providing of a note-off message by the detector 107. Also, the controller 103 controls, in the singing sound producing mode, sound producing and sound stopping by the sound outputter 110 according to the singing sound producing data described later. While the details will be describe later, the singing sound producing data includes a note-on message and a note-off message as note information representing a musical sound, lyrics, note-on time described later, note-off time described later, and duration that is a time span from the note-on time to the note-off time, in association with each other. The controller 103 causes the sound outputter 110 to start, at the timing according to the note-on time, producing sound producing according to the analog musical sound signal representing the musical sound specified by the note information associated with the note-on time, and the analog lyrics signal representing the lyrics associated with the note-on time. As a result, the sound outputter 110 utters the lyrics represented by the singing sound producing data, along with the musical sound represented by the singing sound producing data. The controller 103 causes the sound outputter 110 to stop the sound in response to the elapsing of the duration since the start of the sound producing.

The timer 111 performs timing, and provides the data representing the result of the timing to the controller 103.

Figure 5:
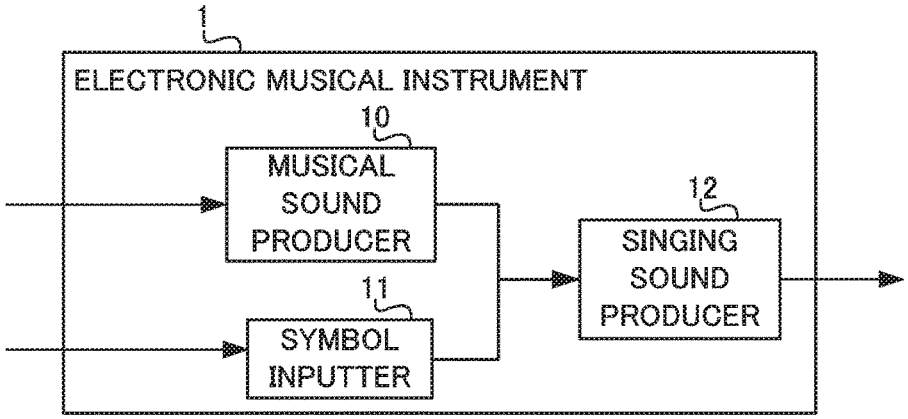
FIG. 5 is a diagram showing a functional configuration of the electronic musical instrument according to the embodiment of the present disclosure.

The electronic musical instrument 1 comprising the above-described physical configuration comprises, as functions of the controller 103, as illustrated in FIG. 5, a musical sound producer 10, a symbol inputter 11, and a singing sound producer 12. The controller 103 functions as each of these units by controlling the electronic musical instrument 1 by executing the above-described control program 105*a*.

In the musical sound producing mode, the musical sound producer 10 accepts a sound producing instruction of a musical sound according to a key pressing operation by a user on a key included in the keyboard 102, and produces a musical sound according to the sound producing instruction. Specifically, in the musical sound producing mode, when a note-on message is provided by the detector 107 in response to a key pressing operation by the user, the musical sound producer 10 causes the musical sound source 108 to generate a digital musical sound signal according to the provided note-on message and provide the generated digital musical sound signal to the sound outputter 110, and also causes the sound outputter 110 to start producing the sound on the basis of an analog musical sound signal according to the provided digital musical sound signal. The musical sound producer 10 causes the sound outputter 110 to stop the sound when a note-off message is provided by the detector 107 in response to a key releasing operation by a user. Also, the musical sound producer 10 generates musical sound data representing a musical sound, a sound producing instruction to produce the music sound being accepted in the musical sound producing mode, and stores the generated musical sound data in the RAM 104. Specifically, the musical sound producer 10 generates musical sound data by storing a note-on message, a note-off message, note-on time, note-off time, and duration in association with each other. The note-on message and the note-off message function as note information for specifying a musical sound, a sound producing instruction to produce the music sound being performed. The note-on time is the time at which the key pressing operation is performed by the user. The musical sound producer 10 acquires the time at which the note-on message is provided by the detector 107 as the note-on time, according to the result of timing by the timer 111. The note-off time is the time at which the key releasing operation is performed by the user. The musical sound producer 10 acquires the time at which the note-off message is provided by the detector 107 as the note-off time, according to the result of timing by the timer 111. The duration is the time span from the note-on time to the note-off time, and equivalent to the duration of the key pressing operation by the user. The musical sound producer 10 stores the generated musical sound data in the RAM 104.

In the symbol input mode, the symbol inputter 11 accepts a symbol input according to a key pressing operation by the user on a key included in the keyboard 102, and generates the lyrics. Specifically, when the note-on message is provided by the detector 107 in response to the key pressing operation by the user, the symbol inputter 11 specifies the key on which the key pressing operation is performed using the note number included in the note-on message, and accepts the symbol input according to the information associated with the key. The symbol inputter 11 accepts a symbol input of information including a character, in response to a pressing of at least one of the character input keys MK shown in FIG. 2. Specifically, the symbol inputter 11 refers, in response to the pressing of a white key 102' and a black key 102" included in the character input keys MK, to the character correspondence data DM shown in FIG. 3 stored in ROM 105, and accepts the symbol input of the information that is associated with the identifier being associated with the black key 102", out of a plurality of pieces of information including a character associated with the white key 102'. For example, in the example shown in FIG. 2, when a white key 102'B and a black key 102"C are pressed, the symbol inputter 11 refers to the character correspondence data DM shown in FIG. 3, and accepts the symbol input of "p" that is a character associated with the identifier "3" being associated with the black key 102"C, out of the characters "b", "i", "p" and "w" that are associated with the white key 102'B. Also, in the example shown in FIG. 2, when a white key 102'G and a black key 102"D are pressed, the symbol inputter 11 refers to the character correspondence data DM shown in FIG. 3, and accepts the symbol input of "." (period) that is associated with the identifier "4" being associated with the black key 102"D, out of the characters "g", "n", "u" and "." (period) that are associated with the white key 102'G. As described above, the symbol inputter 11 accepts, in response to key pressing operations on a white key 102' and a black key 102" included in the character input keys MK, a symbol input of information including a character specified by the combination of the key pressing operations. Note that, in this case, it is assumed that the symbol inputter 11 accepts the symbol input of the same information regardless of which of the key pressing operation to the white key 102' included in the character input keys MK and the key pressing operation to the black key 102" included in the character input keys MK is performed earlier. Also, the symbol inputter 11 refers, in response to a pressing of a key of information input keys FK shown in FIG. 2, to the information correspondence data DF stored in the ROM 105, and accepts a symbol input of information other than a character, according to the information associated with the key. When the information input in the accepted the symbol input is an editing command or an instruction command, the symbol inputter 11 performs a process according to the command. For example, in response to the pressing of a black key 102"*c* shown in FIG. 2, the symbol inputter 11 accepts a symbol input of an editing command, which is associated with the black key 102"*c*, instructing to delete information being input in the symbol input at the current symbol input position, and deletes, according to the editing command, the information being input in the symbol input at the current symbol input position. Also, the symbol inputter 11, in response to a pressing of a white key 102'*a* included in the information input keys FK and one of the black keys 102"A to 102"D included in the character input keys MK, accepts a symbol input of a special character that is associated with the identifier being associated with the pressed black key 102", out of a plurality of special characters "'", "&", "!" and "?" associated with the white key 102'*a*. Note that, in this case, it is assumed that the symbol inputter 11 accepts the symbol input of the same information regardless of which of the key pressing operation to the white key 102' included in the information input keys FK and the key pressing operation to the black key 102" included in the character input keys MK is performed earlier. The symbol inputter 11 generates lyrics data representing lyrics by acquiring characters having been input in the symbol input as the lyrics. Specifically, the symbol inputter 11, in response to a pressing of the black key 102"*b* shown in FIG. 2, accepts a symbol input of an editing command, which is associated with the black key 102"*b*, instructing to decide the content of the symbol input. The symbol inputter 11 generates, according to the editing command, by acquiring characters currently having been input in the symbol input as lyrics, lyrics data representing the lyrics. The symbol inputter 11 stores the generated lyrics data in the RAM 104.

In the singing sound producing mode, the singing sound producer 12 utters the lyrics represented by the lyrics data generated by the symbol inputter 11, at the pitch represented by the musical sound data generated by the musical sound producer 10. That is, the singing sound producer 12 utters the lyrics generated by the symbol inputter 11 by accepting the symbol input, along with a musical sound, a sound producing instruction to produce the musical sound being accepted by the musical sound producer 10. The singing sound producer 12 is equivalent to a sound producer. Specifically, the singing sound producer 12 generates singing sound producing data by acquiring musical sound data and lyrics data stored in the RAM 104, performing word allocation process referring to word allocation rule data DR stored in the ROM 105, and allocating the lyrics represented by the lyrics data to the musical sound whose pitch is represented by the musical sound data. The word allocation rule data DR is the data representing a word allocation rule that is the rule, which is set by a user in advance, for allocating lyrics to musical sounds. The word allocation rule data DR is generated in an external apparatus such as a computer and the like, by accepting a setting operation by a user. The electronic musical instrument 1 acquires the word allocation rule data DR from the external apparatus via the above-described external interface, and stores the acquired word allocation rule data DR in the ROM 105 in advance. In the present embodiment, the singing sound producer 12 allocates, according to the word allocation rule data DR, one character of the lyrics to one musical note represented by the musical sound data. Note that, the above description is merely an example, and the user can arbitrarily set the word allocation rule. The singing sound producing data generated by the above-described word allocation process includes lyrics, a note-on message and a note-off message as note information for specifying a musical sound, note-on time, note-off time, and duration, in association with each other. The singing sound producer 12 provides the singing sound producing data to the musical sound source 108 and the lyrics sound source 109, and causes the musical sound source 108 and the lyrics sound source 109 to generate a digital musical sound signal representing the musical sound and a digital lyrics signal representing the lyrics and to provide the generated digital musical sound signal and digital lyrics signal to the sound outputter 110. The singing sound producer 12 controls sound producing and sound stopping by the sound outputter 110 according to the singing sound producing data to cause the sound outputter 110 to produce sound on the basis of the analog lyrics signal representing the lyrics while producing sound on the basis of the analog musical sound signal representing a musical sound associated with the lyrics.

Figure 6:
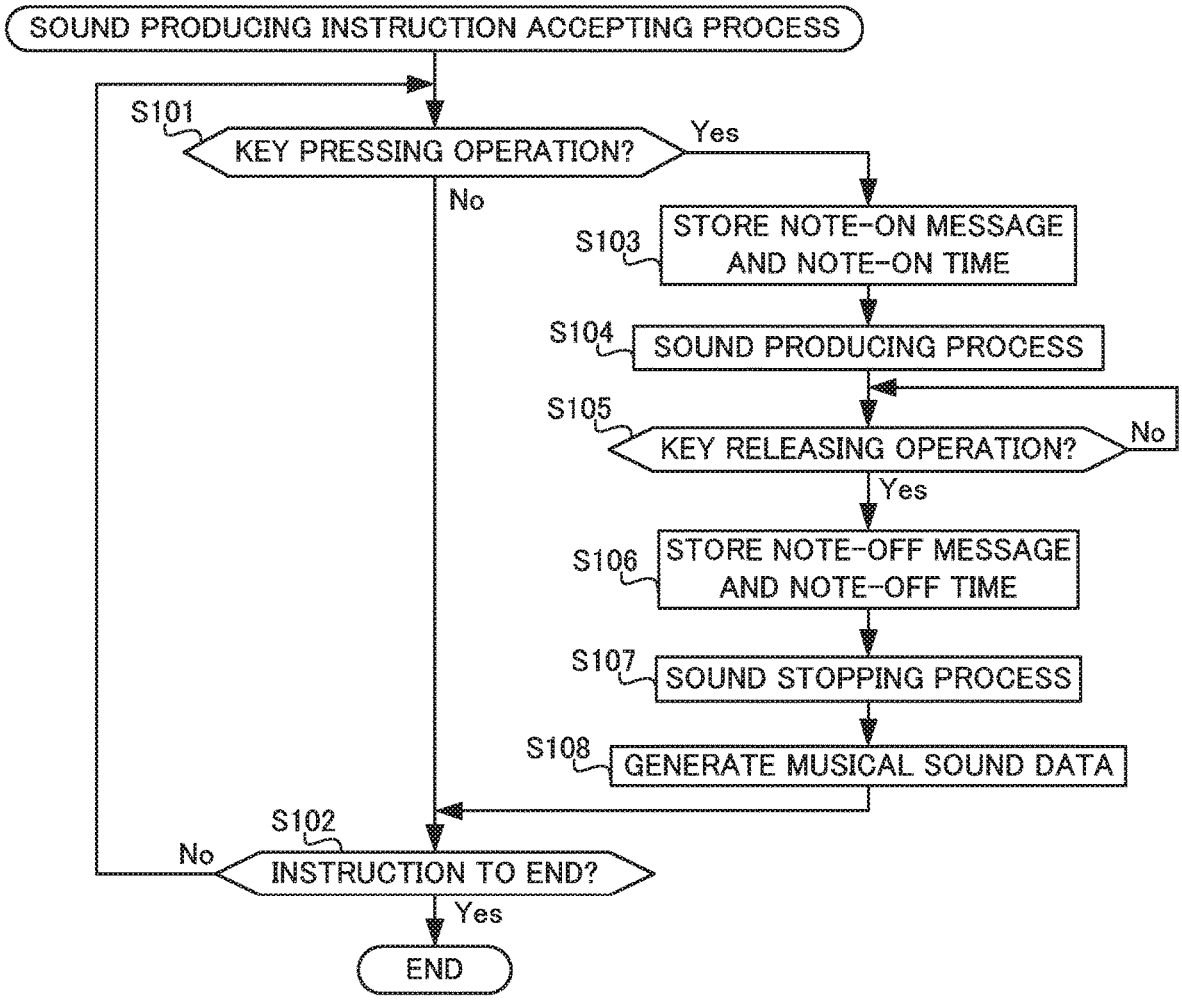
FIG. 6 is a flowchart for describing a sound producing instruction accepting process performed by the electronic musical instrument according to the embodiment of the present disclosure.
Figure 7:
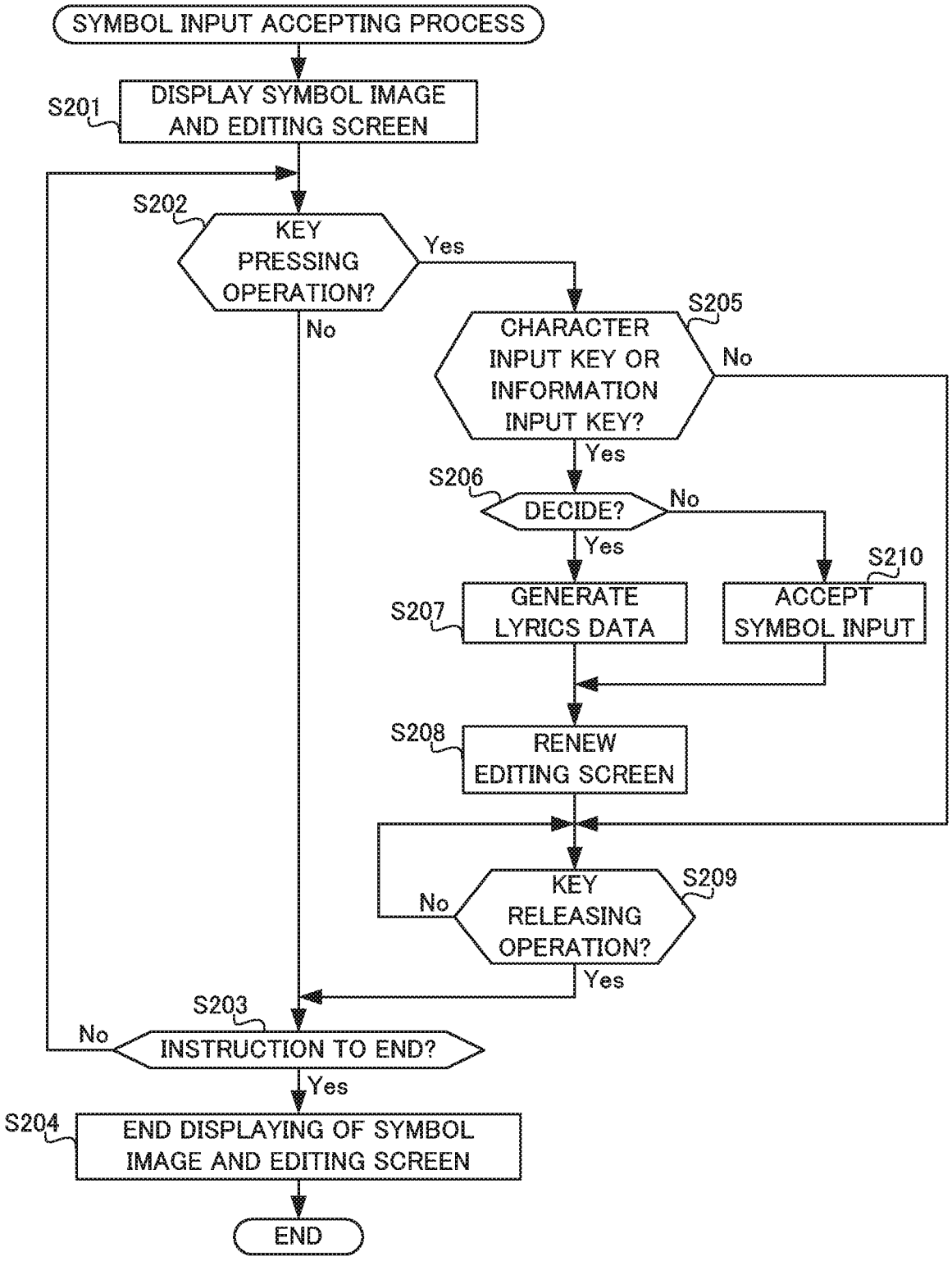
FIG. 7 is a flowchart for describing a symbol input accepting process performed by the electronic musical instrument according to the embodiment of the present disclosure.
Figure 8:
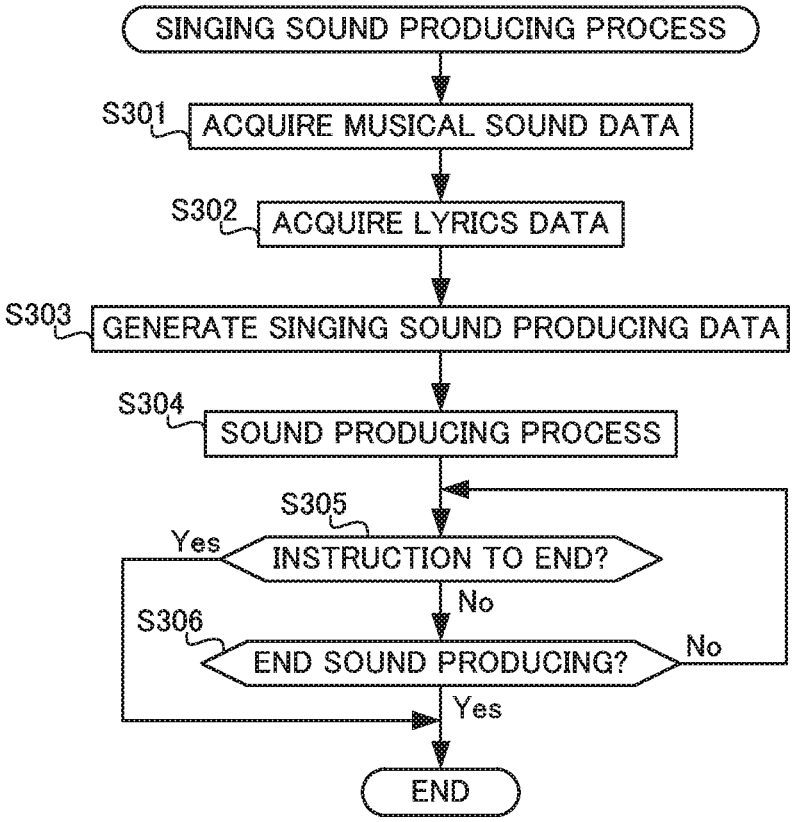
FIG. 8 is a flowchart for describing singing sound producing process performed by the electronic musical instrument according to the embodiment of the present disclosure.

Hereinafter, the sound producing instruction accepting process, symbol input accepting process, and singing sound producing process performed by the electronic musical instrument 1 comprising the above-described physical and functional configuration will be described with reference to flowcharts of FIG. 6 to FIG. 8. Note that, prior to performing the sound producing instruction accepting process, symbol input accepting process and singing sound producing process, the electronic musical instrument 1 acquires the character correspondence data DM, the information correspondence data DF and the word allocation rule data DR from the external apparatus via the above-described external interface, and stores these data in the ROM 105 in advance. Also, the electronic musical instrument 1 acquires the above-described sample musical sound data from the external apparatus via the external interface, and stores the acquired sample musical sound data in the above-described non-volatile memory included in the musical sound source 108 in advance. Also, the electronic musical instrument 1 acquires the above-described sound element data from the external apparatus via the external interface, and stores the acquired sound element data in the above-described non-volatile memory included in the lyrics sound source 109.

Firstly, with reference to the flowchart of FIG. 6, the sound producing instruction accepting process performed by the electronic musical instrument 1 in the musical sound producing mode will be described. When the user instructs, after selecting the musical sound producing mode as the operation mode of the electronic musical instrument 1 by operating the above-described mode selection button of the operator 100, the electronic musical instrument 1 to start the operation according to the musical sound producing mode by operating the above-described start button of the operator 100, the musical sound producer 10 starts the sound producing instruction accepting process shown in the flowchart of FIG. 6.

Firstly, the musical sound producer 10 determines whether a key pressing operation is performed or not by determining whether a note-on message is provided by the detector 107 or not (step S101). When it is determined that a key pressing operation is not performed (step S101; No), the process proceeds to the step S102. On the other hand, when it is determined that a key pressing operation is performed (step S101; Yes), the musical sound producer 10 acquires, according to the result of the timing by the timer 111, the time at which the note-on message is provided as the note-on time, and stores the acquired note-on time in the RAM 104 along with the provided note-on message (step S103). The musical sound producer 10 provides the provided note-on message to the sound outputter 110, and causes the sound outputter 110 to start producing musical sound associated with the key on which the key pressing operation is performed (step S104). Thereafter, the sound outputter 110 continues to produce the musical sound until the process of the step S107, which will be described later, is performed. Next, the musical sound producer 10 determines whether a key releasing operation is performed or not by determining whether a note-off message is provided by the detector 107 or not (step S105). When it is determined that a key releasing operation is not performed (step S105; No), the process returns to the step S105, and waits for a key releasing operation. On the other hand, when it is determined that a key releasing operation is performed (step S105; Yes), the musical sound producer 10 acquires, according to the result of the timing by the timer 111, the time at which the note-off message is provided as the note-off time, and stores the acquired note-off time in the RAM 104 along with the provided note-off message (step S106). The musical sound producer 10 causes the sound outputter 110 to stop the musical sound (step S107). The musical sound producer 10 generates musical sound data by storing the note-on message and the note-on time stored in the RAM 104 in the process of step S103, the note-off message and the note-off time stored in the RAM 104 in the process of step S106, and the duration that is the time span from the note-on time to the note-off time in association with each other (step S108). The musical sound producer 10 stores the generated musical sound data in the RAM 104. Next, the musical sound producer 10 determines whether ending of the operation is instructed or not by determining whether an operation to the above-described end button of the operator 100 by a user is accepted or not (step S102). When it is determined that ending of the operation is not instructed yet (step S102; No), the process returns to the step S101. On the other hand, when it is determined that ending of the operation is instructed (step S102; Yes), the musical sound producer 10 ends the sound producing instruction accepting process.

Next, with reference to the flowchart of FIG. 7, the symbol input accepting process performed by the electronic musical instrument 1 in the symbol input mode will be described. When the user instructs, after selecting the symbol input mode as the operation mode of the electronic musical instrument 1 by operating the above-described mode selection button, the electronic musical instrument 1 to start the operation according to the symbol input mode by operating the above-described start button, the symbol inputter 11 starts the symbol input accepting process shown in the flowchart of FIG. 7.

Firstly, the symbol inputter 11 causes the keyboard displayer 106 to display the symbol image SG shown in FIG. 2 on the character input keys MK and the information input keys FK by turning on the above-described light source included in the keyboard displayer 106 while causing the image displayer 101 to display the editing screen HG shown in FIG. 1 (step S201). Thereafter, the keyboard displayer 106 and the image displayer 101 continue displaying the symbol image SG and the editing screen HG respectively until the process of step S204 that will be described later is performed. The symbol inputter 11 determines whether a key pressing operation is performed or not by determining whether a note-on message is provided by the detector 107 or not (step S202). When it is determined that a key pressing operation is not performed (step S202; No), the process proceeds to the step S203. On the other hand, when it is determined a key pressing operation is performed (step S202; Yes), the symbol inputter 11 specifies the key on which the key pressing operation is performed using the note number included in the provided note-on message, and determines whether the key is included in one of the character input keys MK and the information input keys FK or not (step S205). When it is determined that the key on which the key pressing operation is performed is a key other than the character input keys MK or the information input keys FK (step S205; No), the process proceeds to the step S209 without accepting the symbol input, because the key is not associated with information and the key pressing operation to the key is an invalid operation in the symbol input mode. Note that, when the invalid operation is performed, the fact that the operation is invalid may be notified to the user by causing the image displayer 101 to display a notification image being set in advance or by causing the sound outputter 110 to output a notification sound being set in advance. On the other hand, when it is determined that the key on which the key pressing operation is performed is a character input key MK or an information input key FK (step S205; Yes), the symbol inputter 11 determines whether the decision of the content of the symbol input is instructed or not by determining whether the key is the black key 102"*b* shown in the FIG. 2 or not (step S206). When it is determined that the user instructed the decision of the content of the symbol input by performing a key pressing operation on the black key 102"*b* (step S206; Yes), the symbol inputter 11 generates lyrics data by acquiring characters currently having been input in the symbol input as the lyrics (step S207). The symbol inputter 11 stores the generated lyrics data in the RAM 104. On the other hand, when it is determined that the decision of the content of the symbol input is not instructed (step S206; No), the symbol inputter 11 accepts a symbol input according to the information associated with the key on which the key pressing operation is performed (step S210). Specifically, the symbol inputter 11 refers, in response to the pressing of a white key 102' and a black key 102" included in the character input keys MK, to the character correspondence data DM, and accepts a symbol input of a character specified by the combination of the pressed white key 102' and the black key 102". Also, the symbol inputter 11 refers, in response to a pressing of any one of the information input keys FK, to the information correspondence data DF, and accepts a symbol input of information associated with the key and by referring. When the information accepted in the symbol input is an editing command or an instruction command, the symbol inputter 11 performs a process according to the command. Also, the symbol inputter 11 accepts, in response to the pressing of a white key 102'*a* included in the information input keys FK and a black key 102" included in the character input keys MK, a symbol input of the special character associated with the identifier being associated with the pressed black key 102", out of the plurality of special characters "'", "&", "!" and "?" that are associated with the white key 102'*a*. Next, the symbol inputter 11 causes the image displayer 101 to renew the display mode of the editing screen HG according to the content of the symbol input accepted in the step S207 or the step S210 (step S208). That is, an image representing the information being input in the symbol input in the step S207 or the step S210 is displayed in the editing screen HG. Next, the symbol inputter 11 determines whether a key releasing operation is performed or not by determining whether a note-off message is provided by the detector 107 or not (step S209). When it is determined that a key releasing operation is not performed (step S209; No), the process returns to the step S209, and waits for a key releasing operation. On the other hand, when it is determined that a key releasing operation is performed (step S209; Yes), the symbol inputter 11 determines whether ending of the operation is instructed or not by determining whether an operation on the above-described end button of the operator 100 by the user is accepted or not (step S203). When it is determined that ending of the operation is not instructed yet (step S203; No), the process returns to the step S202. On the other hand, when it is determined that ending of the operation is instructed (step S203; Yes), the symbol inputter 11 causes the keyboard displayer 106 to end displaying of the symbol image SG by turning off the light source of the keyboard displayer 106 while causing the image displayer 101 to end displaying of the editing screen HG (step S204), and ends the symbol input accepting process.

Next, with reference to the flowchart of FIG. 8, the singing sound producing process performed by the electronic musical instrument 1 in the singing sound producing mode will be described. The electronic musical instrument 1 generates, prior to the performing of the singing sound producing process, the musical sound data and the lyrics data by performing the sound producing instruction accepting process and the symbol input accepting process, which are described above, and stores these data in the RAM 104. In this state, when the user instructs, after selecting the singing sound producing mode as the operation mode of the electronic musical instrument 1 by operating the above-described mode selection button, the electronic musical instrument 1 to start the operation according to the singing sound producing mode by operating the above-described start button, the singing sound producer 12 starts the singing sound producing process shown in the flowchart of FIG. 8.

Firstly, the singing sound producer 12 acquires the musical sound data from the RAM 104 (step S301). Next, the singing sound producer 12 acquires the lyrics data from the RAM 104 (step S302). The singing sound producer 12 generates singing sound producing data by performing word allocation process according to the word allocation rule data DR stored in the ROM 105 to allocate the lyrics represented by the lyrics data to the musical sound represented by the musical sound data (step S303). The singing sound producer 12 causes the sound outputter 110 to produce sound on the basis of the analog lyrics signal representing the lyrics according to the singing sound producing data generated in the step S303 (step S304). The singing sound producer 12 determines whether ending of the operation is instructed or not by determining whether an operation on the above-described end button by the user is accepted or not (step S305). When it is determined that ending of the operation is instructed (step S305; Yes), the singing sound producer 12 ends the singing sound producing process. On the other hand, when it is determined that ending of the operation is not instructed (step S305; No), the singing sound producer 12 determines whether to end the sound producing according to the singing sound producing data or not by determining whether all the lyrics included in the singing sound producing data is uttered or not (step S306). When it is determined that a part of the lyrics included in the singing sound producing data is not uttered yet (step S306; No), the process returns to the step S305. On the other hand, when it is determined that all of the lyrics included in the singing sound producing data are uttered (step S306; Yes), the singing sound producer 12 ends the singing sound producing process.

As described above, the electronic musical instrument 1 accepts a symbol input including a character according to the key pressing operation on a key included in the keyboard 102, and can improve the operability.

In the symbol input mode, the electronic musical instrument 1 accepts a symbol input using the keyboard 102 that accepts sound producing instruction of musical sound in the musical sound producing mode. As a result, the electronic musical instrument 1 can accept a symbol input according to an intuitive operation by the user in the similar way as the sound producing instruction of the musical sound, therefore the operability is improved. Also, since a means that accepts a symbol input is not needed to be provided separately from the keyboard 102 that accepts a sound producing instruction of musical sound, miniaturization and weight reduction of the electronic musical instrument 1 can be realized, and the degrading of the design of the electronic musical instrument 1 due to providing of the means can be suppressed.

Also, the electronic musical instrument 1 accepts a symbol input of a character according to a key pressing operation on character input keys MK composed of keys of one octave. Thus, the user can perform a symbol input of a character by easily pressing a plurality of keys included in the character input keys MK with one hand, therefore the operability is improved.

While the embodiment of the present disclosure is described above, the above-described embodiment is an example, and the application range of the present disclosure is not limited to the embodiment. That is, various applications of the embodiment of the present disclosure are possible, and any embodiment is included in the scope of the present disclosure.

For example, in the above-described embodiment, it is described that various information is associated with a key included in the keyboard 102 in the manner shown in the FIG. 2, but this is merely an example. Various types of information may be associated with a key included in the keyboard 102 in an arbitrary manner.

Figure 9:
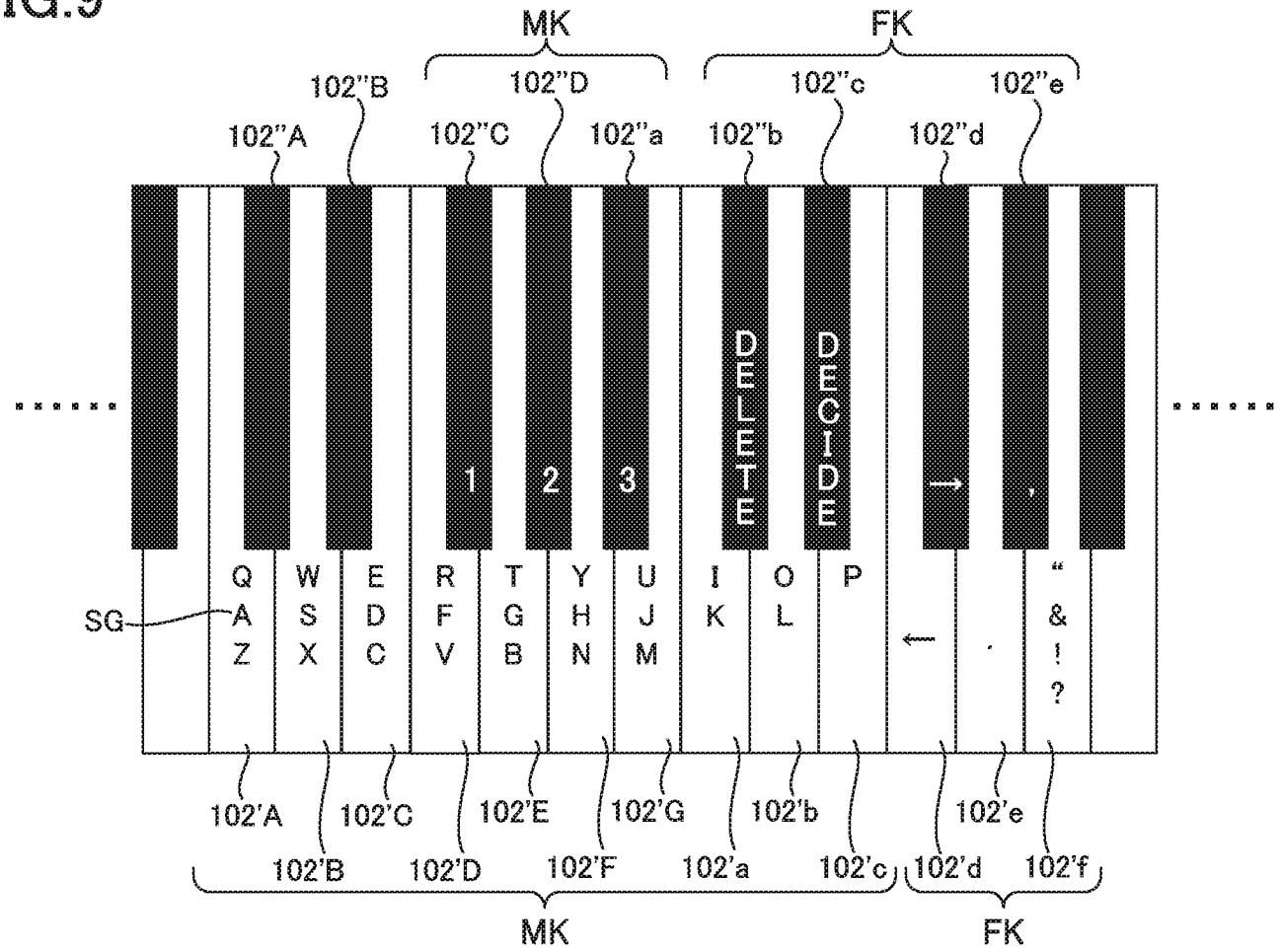
FIG. 9 is a second diagram for describing a correspondence relation between a key and information.

Note that, the various information and the key included in the keyboard 102 may be associated with one another in the manner shown in FIG. 9. In the example of FIG. 9, the characters "A" to "Z" are associated with white keys 102'A to 102'G and 102'*a* to 102'*c* included in the character input keys MK, according to the QWERTY layout of a keyboard. One to three characters are respectively associated with the white keys 102'A to 102'G and 102'*a* to 102'*c*, and numerals "1" to "3" are associated with each of characters as identifiers. Also, one of the numerals "1" to "3" is respectively associated with the black keys 102"C, 102"D, and 102"*a* included in the character input keys MK. When a white key 102' and a black key 102" included in the character input keys MK are pressed, the electronic musical instrument 1 accepts a symbol input of the character with which the numeral associated with the pressed black key 102" is associated as the identifier, out of the characters associated with the pressed white key 102'. Note that, in the example of FIG. 10, a plurality of special characters "'", "&", "!" and "?" are associated with the white key 102'*e* included in the information input keys FK. For each of the special characters, one of the numerals "1" to "4" is assigned as an identifier. Specifically, as the identifier, the numeral "1" is assigned to the special character "'", the numeral "2" is assigned to the special character "&", the numeral "3" is assigned to the special character "?", and numeral "4" to the special character "?", respectively. The electronic musical instrument 1 specifies, according to the number of times the key pressing operation is performed on a white key 102'*e*, one of the plurality of special characters associated with the white key 102'*e*, and accepts the symbol input of the specified special character. Specifically, the electronic musical instrument 1 accepts the symbol input of the special character "'" to which the numeral "1" is assigned as the identifier when the remainder of dividing the number of times of the key pressing operation on the white key 102'*e* by 4 is 1. Likewise, the electronic musical instrument 1 accepts the symbol input of the special character "&" when the remainder of dividing the number of times of the key pressing operation on the white key 102'*e* by 4 is 2, accepts the symbol input of the special character "!" when the reminder is 3, and accepts the symbol input of the special character "?" when the reminder is 0.

In the above-described embodiment, it is described that a symbol input of the character according to the identifier associated with the pressed black key 102", out of the plurality of characters associated with the pressed white key 102' included in the character input keys MK, is accepted. However, this is merely an example, and one of the plurality characters associated with the white key 102' may be specified by another method, and the symbol input may be accepted. For example, the electronic musical instrument 1 may accept, in response to the plurality of times of pressing a white key 102', a symbol input of one of the plurality of characters associated with the white key 102' according to the number of times the key is pressed. Note that, while it is described, in the above-described embodiment, that a plurality of characters is associated with a white key 102', this is merely an example, and a plurality of pieces of information including information other than a character such as a symbol, a special character, a command and the like may be associated with the white key 102'. Also, while it is described, in the above-described embodiment, that a plurality of characters is associated with the white key 102', and an identifier is associated with the black key 102", this is merely an example. An identifier may be associated with the white key 102', and a plurality of characters may be associated with the black key 102". Also, an identifier and a plurality of characters may be associated with a white key 102', or alternatively, an identifier and a plurality of characters may be associated with a black key 102". That is, the electronic musical instrument 1 may accept, in response to the pressing of a plurality of white keys 102', a symbol input according to the combination of the pressed white keys 102'. Also, the electronic musical instrument 1 may accept, in response to the pressing of a plurality of black keys 102", a symbol input according to the combination of the pressed black keys 102".

In the above-described embodiment, it is described that the lyrics generated by accepting a symbol input is uttered with a musical sound having the pitch whose sound producing instruction is accepted in the musical sound producing mode. However, this is merely an example, and the electronic musical instrument 1 can utter the lyrics along with a musical sound whose pitch is designated by an arbitrary method. For example, the electronic musical instrument 1 may acquire data representing a musical sound via the above-described external interface from an external apparatus, and utter the lyrics along with the musical sound represented by the data.

While it is described, in the above-described embodiment, that a symbol input of a character, a special character, a symbol, an editing command and an instruction command are accepted according to the key pressing operation of the character input keys MK and the information input keys FK, this is merely an example. The electronic musical instrument 1 can accept a symbol input of arbitrary type of information according to the key pressing operation on a key included in the keyboard 102. For example, the electronic musical instrument 1 may accept a symbol input of a numeral, a figure, a command instructing a change of the operation mode and the like. Also, while it is described, in the above-described embodiment, that the lyrics is generated by accepting a symbol input of a character, this is merely an example. By accepting a symbol input of a character, arbitrary character information such as a song title, performance date, and data file name and the like may be generated.

Note that, while it is needless to say that an electronic musical instrument comprising a configuration for realizing the functions according to the present disclosure in advance may be provided as an electronic musical instrument according to the present disclosure, it is also possible to cause an existing electronic musical instrument to function as an electronic musical instrument according to the present disclosure, by applying a program. That is, by applying a program for realizing each functional configuration of the electronic musical instrument according to the present disclosure so that a computer controlling an existing electronic musical instrument can execute, the existing electronic musical instrument can be caused to function as the electronic musical instrument according to the present disclosure. Note that, such a program can be applied by an arbitrary method. The program may be, for example, stored in a non-transitory computer-readable recording medium such as a flexible disk, a compact disc read-only memory (CD-ROM), digital versatile disc ROM (DVD-ROM), a memory card and the like, and may be applied. Moreover, the program may be superimposed on a carrier wave, and may be applied via a communication network such as the Internet and the like. For example, the program may be posted on a bulletin board system (BBS) on a communication network, and may be distributed. Then, by starting the program, and executing the program under the control of an operating system (OS), in the way similar to the way in which other application programs are executed, a configuration for performing the above-described processes may be realized.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A keyboard musical instrument comprising:

a keyboard including a white key, a first black key, and a second black key, respectively corresponding to mutually different pitch data, wherein the white key is allocated with plural characters including a first character and a second character; and a processor that executes:

in a musical sound producing mode that is set, accepting a sound producing instruction of a musical sound in response to an operation of the white key; and in a symbol input mode that is set, (i) according to designations of both the white key and the first black key, accepting an input of the first character, and (ii) according to designations of both the white key and the second black key, accepting an input of the second character.

2. The keyboard musical instrument according to claim 1, wherein at least one vowel character and plural consonant characters are allocated to the white key.

3. The keyboard musical instrument according to claim 1, wherein:

the processor further executes displaying plural characters arranged in one vertical column on the white key; and according to the designation of the first black key according to an operation by a user, one row of the plural characters arranged in one vertical column on the white key is designated.

4. The keyboard musical instrument according to claim 3, wherein the plural characters are displayed on the white key by lighting the white key, when the symbol input mode is set.

5. The keyboard musical instrument according to claim 1, wherein:

the keyboard includes plural black keys including the first black key and the second black key; and a number of the plural black keys is the same as a number of plural characters allocated to the white key.

6. The keyboard musical instrument according to claim 1, wherein:

the keyboard includes plural white keys including the white key, and plural black keys including the first black key and the second black key; and the plural white keys and the plural black keys are arranged within at least 2 octaves.

7. The keyboard musical instrument according to claim 1, wherein an input of the first character is accepted, when the first black key is designated by a user after the white key is designated by a user.

8. The keyboard musical instrument according to claim 1, wherein an input of the first character is accepted, when the white key is designated by a user after the first black key is designated by a user.

9. The keyboard musical instrument according to claim 1, wherein the processor executes uttering lyrics generated on a basis of a character accepted in the symbol input mode at a pitch being designated.

10. A method that is executable by a computer of a keyboard musical instrument comprising a keyboard including a white key, a first black key, and a second black key, respectively corresponding to mutually different pitch data, wherein the white key is allocated with plural characters including a first character and a second character, the method comprising:

in a musical sound producing mode that is set, accepting a sound producing instruction of a musical sound in response to an operation of the the white key; and in a symbol input mode that is set, (i) according to designations of both the white key and the first black key, accepting an input of the first character, and (ii) according to designations of both the white key and the second black key, accepting an input of the second character.

11. A non-transitory computer-readable recording medium storing a program that is executable by a computer of a keyboard musical instrument comprising a keyboard including a white key, a first black key, and a second black key, respectively corresponding to mutually different pitch data, wherein the white key is allocated with plural characters including a first character and a second character, the program being executable by the computer to cause the computer to execute:

in a musical sound producing mode that is set, accepting a sound producing instruction of a musical sound in response to an operation of the white key; and in a symbol input mode that is set, (i) according to designations of both the white key and the first black key, accepting an input of the first character, and (ii) according to designations of both the white key and the second black key, accepting an input of the second character.

* * * * *